US008963825B2

(12) United States Patent
Hsu et al.

(10) Patent No.: US 8,963,825 B2
(45) Date of Patent: Feb. 24, 2015

(54) DISPLAY DEVICE

(71) Applicant: Micro-Star Int'l Co., Ltd., New Taipei (TW)

(72) Inventors: Chien-Chi Hsu, Tongsiao Township (TW); Ping-Chun Hsieh, New Taipei (TW)

(73) Assignee: MSI Computer (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 13/956,155

(22) Filed: Jul. 31, 2013

(65) Prior Publication Data

US 2015/0009239 A1 Jan. 8, 2015

(30) Foreign Application Priority Data

Jul. 5, 2013 (TW) ..... 102212804 U

(51) Int. Cl.
*G09G 3/36* (2006.01)

(52) U.S. Cl.
CPC ..... *G09G 3/3696* (2013.01)
USPC ..... 345/102; 345/87

(58) Field of Classification Search
USPC ..... 345/87, 102; 349/65, 69
See application file for complete search history.

(56) References Cited

U.S. PATENT DOCUMENTS

| | | | | |
|---|---|---|---|---|
| 6,359,391 | B1 * | 3/2002 | Li | 315/291 |
| 2005/0190142 | A1 * | 9/2005 | Ferguson | 345/102 |
| 2009/0091560 | A1 * | 4/2009 | Ferguson | 345/207 |
| 2012/0313917 | A1 * | 12/2012 | Yamada | 345/211 |
| 2014/0139499 | A1 * | 5/2014 | Hussain et al. | 345/204 |

* cited by examiner

*Primary Examiner* — Ricardo L Osorio
(74) *Attorney, Agent, or Firm* — Maschoff Brennan

(57) ABSTRACT

A display device includes a backlight module, a backlight control module and a flicker removing module. The backlight module electrically connected between an input pin and an output pin which belong to the backlight control module, provides a backlight source to a display panel. The input pin receives a first voltage to control a continuity of an input current which is supplied to the backlight module and has no frequency variation. The flicker removing module electrically connected to the output pin receives a pulse width modulation signal and according to a duty cycle of the pulse width modulation signal, controls an output current outputted by the output pin, so as to control the backlight control module to control the input current according to the output current. The input current is associated with a backlight brightness of the backlight module.

13 Claims, 7 Drawing Sheets

DISPLAY DEVICE

CROSS-REFERENCE TO RELATED APPLICATIONS

This non-provisional application claims priority under 35 U.S.C. §119(a) on Patent Application No(s). 102212804 filed in Taiwan, R.R.C. on Jul. 5, 2013, the entire contents of which are hereby incorporated by reference.

TECHNICAL FIELD

The disclosure relates to a display device, more particularly to a display device capable of removing flickers for a display panel.

BACKGROUND

Refer to FIG. 1 which is a block diagram of a conventional display device, a display device 9 includes a backlight module 90, a display panel 92, a backlight control module 94, a resistance unit 96 and a signal input module 98. The backlight module 90 includes a light-emitting diode (LED) array, and the backlight control module 94 includes a boost module 940 and a pulse width modulation (PWM) backlight controller 942.

The backlight module 90 is disposed at one side of the display panel 92 and provides the backlight source to the display panel 92. The PWM backlight controller 942 has a pin VCC, a pin DIM (i.e. a light dimming pin), a pin EN (i.e. an enable pin), a pin GND and a pin ISET. The pins VCC, DIM, EN and GND are the input pins of the PWM backlight controller 942, and the pin ISET is an output pin of the PWM backlight controller 942. The backlight module 90 is electrically connected to the boost module 940 and the PWM backlight controller 942 in the backlight control module 94. The boost module 940 is electrically connected to the PWM backlight controller 942. The resistance unit 96 is electrically connected between the pin ISET of the PWM backlight controller 942 and a ground end.

The pins VCC, DIM, EN and GND of the PWM backlight controller 942 are electrically connected to the signal input module 98. The pins VCC, DIM and EN are supplied with an external power source Vin, a PWM signal and a first voltage V1 respectively, and the pin GND is grounded. The external power source Vin is increased by the boost module 940 and then is supplied as power to the LED array in the backlight module 90 and the PWM backlight controller 942 in the backlight control module 94. The PWM signal is a basis that the backlight control module 94 adjusts the brightness. The first voltage V1 as an enable signal is fixed and used for being supplied to the backlight control module 94.

After the external power source Vin is increased via the boost module 940, the backlight control module 94 supplies power to the LED array in the backlight module 90 and through the PWM dimming technique, controls the brightness to the LED array. Specifically, the PWM dimming technique to adjust the brightness to the LED array is based on the duty cycle of the PWM signal, and the maximum of the output current Iout outputted by the pin ISET can be set through the design of the resistance unit 96.

FIG. 2 is a waveform diagram of an output current of the pulse width modulation backlight controller in FIG. 1. When the duty cycle of the PWM signal supplied to the pin DIM becomes greater, the brightness to the LED array in the backlight module 90 will become greater. In contrast, when the duty cycle of the PWM signal supplied to the pin DIM becomes smaller, the brightness to the LED array in the backlight module 90 will become smaller.

However, such a PWM dimming technique causes that flickers occur on the display device 9 two or three hundred times per second. In other words, the input current Iin outputted by the backlight control module 94 will change with a frequency of 200 or 300 hertz. It is not easy for human eyes to feel flickers occurring on the display device 9 because of the vision persistence, even though the human eyes view only thirty frames per second. Since the flickers may occur on the display device 9 more than 5 million times in eight hours in one day, this may cause a heavy burden to the human eyes and even cause eye diseases such as the computer vision syndrome. Moreover, when a camera or a video camera is used for capturing the images presented by the display device 9, lines may occur on captured images.

In order to remove the flickers, the conventional resolution is that the PWM backlight controller 942 in the backlight control module 94 is replaced by a current control chip having an inter-integrated circuit (I2C), thereby controlling the brightness to the display device through the linear current dimming manner. However, this solution will cause the more complicated circuit design within the display device and cause higher manufacture costs.

SUMMARY

A display device according to an embodiment of the disclosure includes a backlight module, a backlight control module and a flicker removing module. The backlight module includes at least one backlight unit which is configured to supply a backlight source required by a display panel. The backlight control module includes a pulse width modulation backlight controller and a boost module. The pulse width modulation backlight controller has an input pin and an output pin between which the backlight module is electrically connected. A first voltage supplied to the input pin is used for controlling a continuity of an input current of the backlight module. The flicker removing module electrically connected to the output pin is configured to receive a pulse width modulation signal and according to a duty cycle of the pulse width modulation signal, controls an output current outputted by the output pin. The backlight control module according to the output current controls the input current supplied to the backlight module. The input current is associated with a backlight brightness to the at least one backlight unit.

A control method for a display device comprising a backlight module and a backlight control module includes the following steps according to an embodiment of the disclosure. A first voltage is received and then is supplied to the backlight module. An output current outputted by an output pin of the backlight control module is controlled according to a duty cycle of a pulse width modulation (PWM) signal. According to the output current, an input current which is supplied to the backlight module and is associated with a backlight brightness to the backlight module, is controlled.

BRIEF DESCRIPTION OF THE DRAWINGS

The present disclosure will become more fully understood from the detailed description given herein below for illustration only and thus does not limit the present disclosure, wherein.

DETAILED DESCRIPTION

Figure 1:
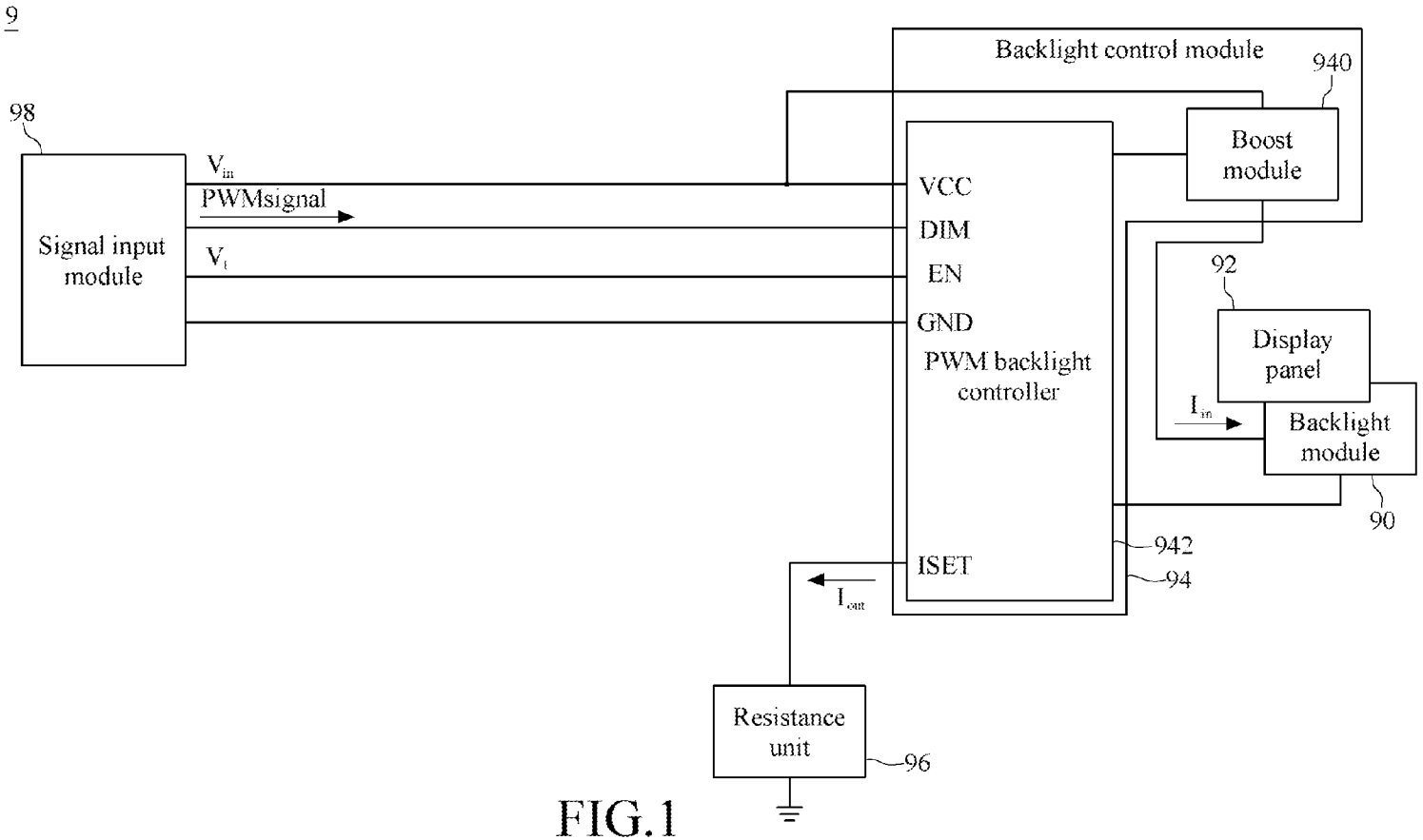
FIG.1 (PRIOR ART)
FIG. 1 is a block diagram of a conventional display device.
Figure 2:
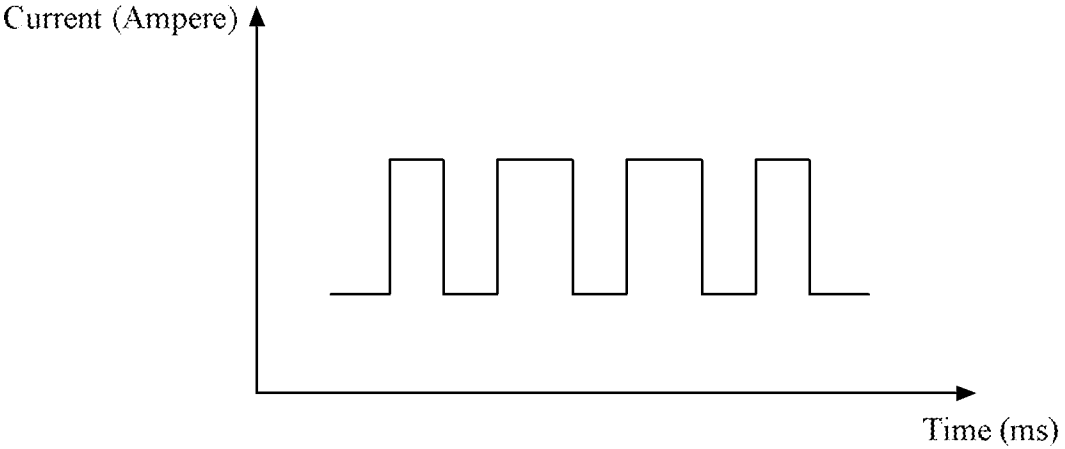
FIG.2 (PRIOR ART)
FIG. 2 is a waveform diagram of an output current of the pulse width modulation backlight controller in FIG. 1.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 3:
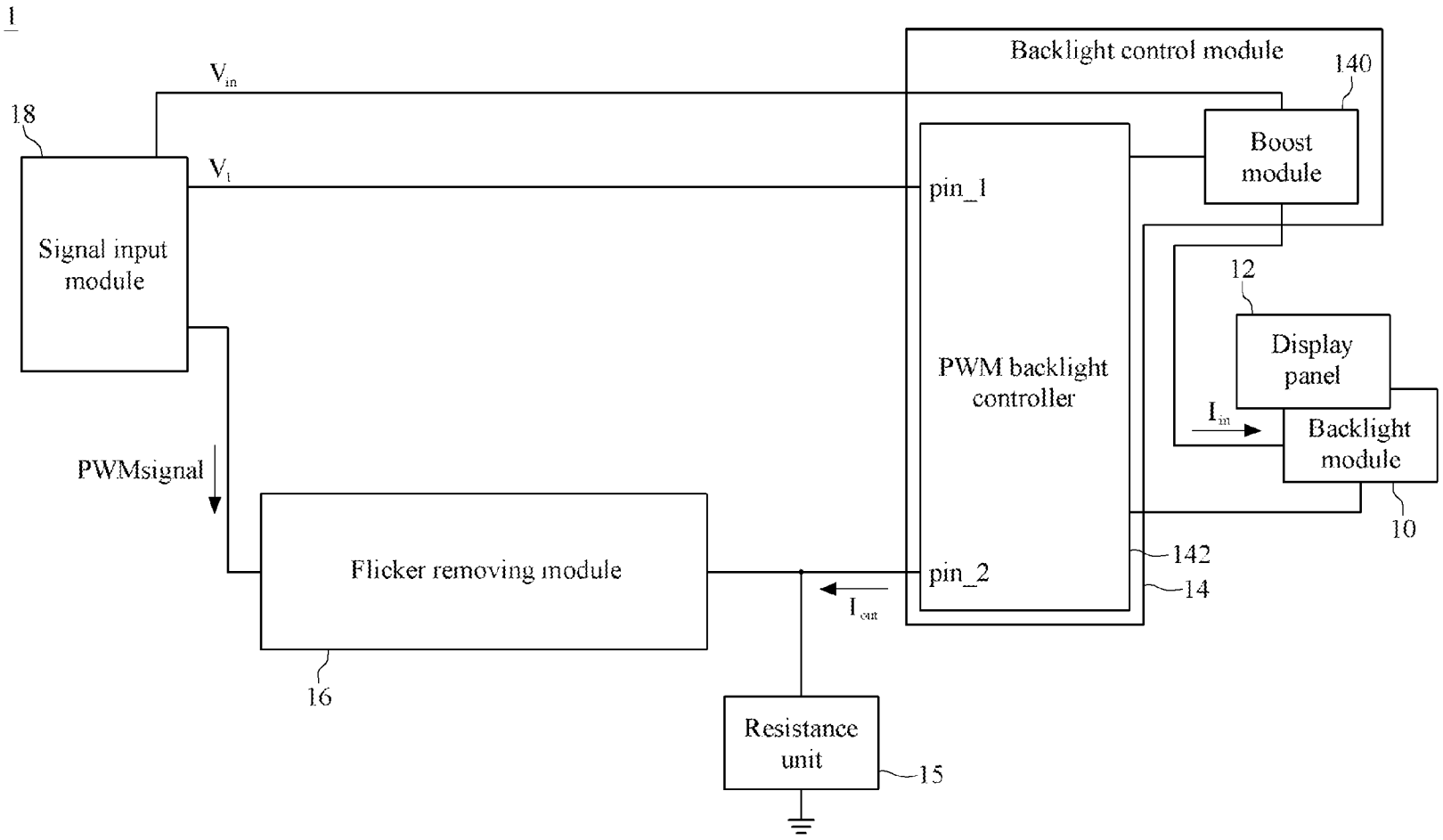
FIG. 3 is a block diagram of a display device according to an embodiment of the disclosure.

FIG. 3 is a block diagram of a display device according to an embodiment of the disclosure. A display device 1 includes a backlight module 10, a display panel 12, a backlight control module 14, a resistance unit 15, a flicker removing module 16 and a signal input module 18. The backlight control module 14 includes a pulse width modulation (PWM) backlight controller 142 and a boost module 140. The PWM backlight controller 142 has an input pin pin_1 and an output pin pin_2. The input pin pin_1 is electrically connected to the signal input module 18, and the output pin pin_2 is electrically connected to one end of the resistance unit 15 and one end of the flicker removing module 16. The other end of the flicker removing module 16 is electrically connected to the signal input module 18.

The backlight module 10 is electrically connected to the boost module 140 in the backlight control module 14. The boost module 140 is configured to increase the voltage potential of an external power source Vin, so as to supply power to the LED array in the backlight module 10. In other words, for a signal transmission path between the backlight module 10 and the backlight control module 14, the PWM backlight controller 142 controls the continuity of the input current Iin supplied to the backlight module 10 via its input pin pin_1 and then controls the input current Iin supplied to the backlight module 10 via its output pin pin_2. The detailed operation of each module in the display device 1 is described as follows.

The backlight module 10 includes at least one backlight unit (not shown) configured to provide the backlight source for the display panel 12. The backlight source can be the light presented by any possible color such as green, blue or white. Generally, the backlight module 10 is disposed at one side of the display panel 12. For instance, the backlight module 10 is disposed at the down-side of the display panel 12. In this or some embodiments, the backlight module 10 can be the direct back-lit type or the edge back-lit type, the display panel 12 can be a liquid crystal display panel, and the backlight unit can be light-emitting diodes (LEDs). Moreover, the display device 1 can be a 24-inch monitor or a 27-inch monitor. The disclosure will not be limited by a quantity of the backlight units, an arrangement of the backlight units, and a size of the display panel 12.

The input pin pin_1 of the PWM backlight controller 142 in the backlight control module 14 is supplied with a first voltage V1 outputted by the signal input module 18, so that the PWM backlight controller 142 can control the continuity of the input current Iin supplied to the backlight module 10. In other words, the backlight control module 14 supplies power to the at least one backlight unit in the backlight module 10. In this or some embodiments, the first voltage V1 is a stable DC voltage, i.e. the first voltage V1 is constant.

The flicker removing module 16 receives the PWM signal PWMsignal and adjusts the duty cycle of the PWM signal PWMsignal to control the output current Iout outputted by the output pin pin_2 of the backlight control module 14. Accordingly, the backlight control module 14 can control the input current Iin supplied to the backlight module 10 according to the output current Iout, so that the backlight brightness to the backlight unit will be increased or decreased with the change of the input current Iin. In other words, the input current Iin is associated with the backlight brightness to the backlight unit.

In this way, the display device 1 can control the input current Iin supplied to the backlight module 10 according to the output current Iout, so as to adjust the backlight brightness to the backlight unit. Specifically, the disclosure lowers the output current Iout to reduce the percentage of blue light in the light emitted by the backlight unit, so that the blue light irritates human eyes much less. The so-called blue light may has high energy, has a wavelength between 400 and 500 nanometers, and can pass through the eye lens and be sent to the retina, resulting in vision damages such as the macular degeneration or the cataract.

Figure 4:
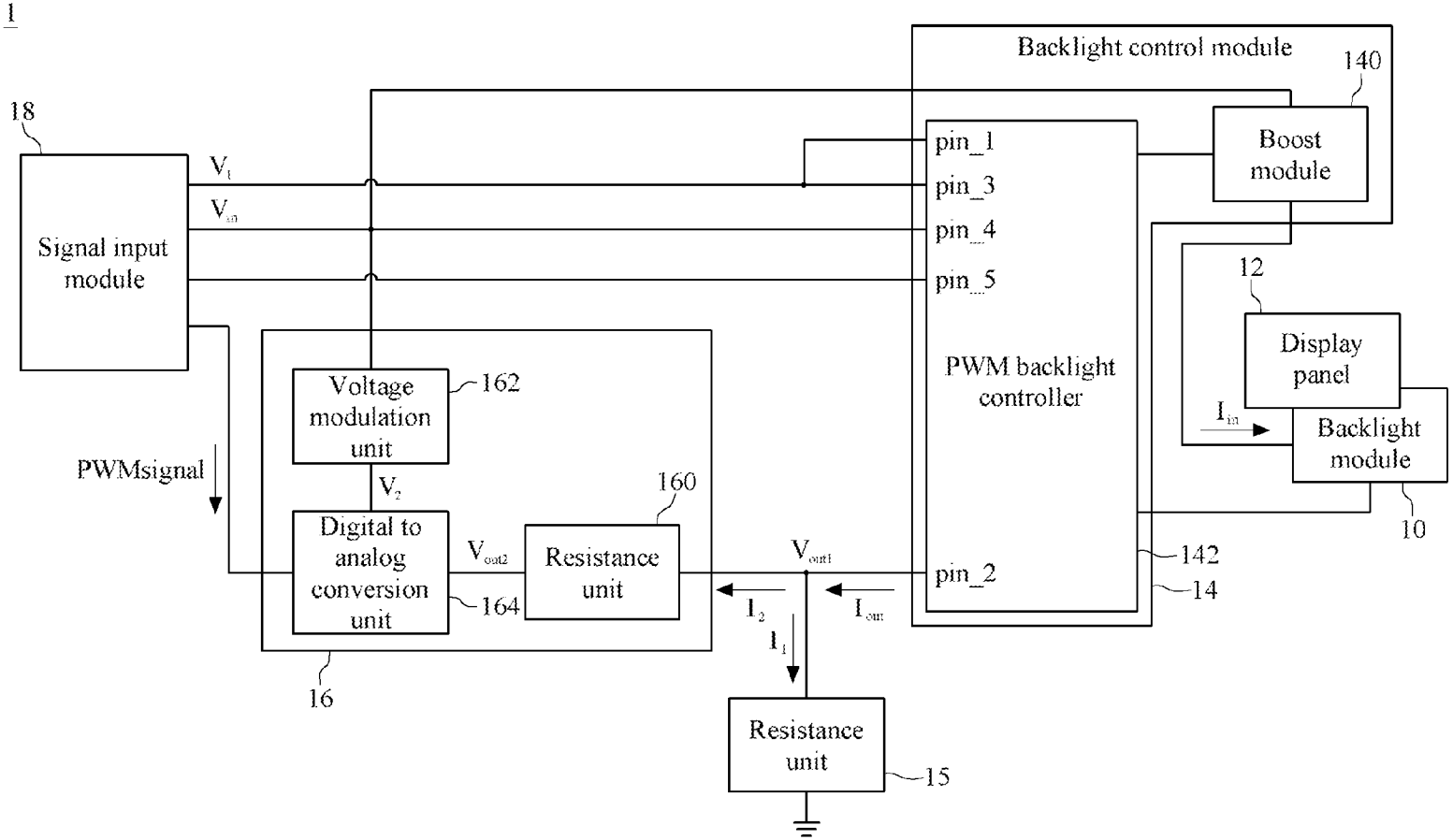
FIG. 4 is a detailed block diagram of the display device in FIG. 3.

The detailed operation between the backlight control module 14 and the flicker removing module 16 is described as follows. FIG. 4 is a detailed block diagram of the display device in FIG. 3. The PWM backlight controller 142 in the backlight control module 14 further includes three input pins pin_3, pin_4 and pin_5 besides the input pin pin_1 and the output pin pin_2. The input pins pin_1 and pin_3 are simultaneously supplied with the first voltage V1 outputted by the signal input module 18, and the input pin pin_4 is supplied with the external power source Vin outputted by the signal input module 18. In an embodiment, the external power source Vin is a voltage to drive the PWM backlight controller 142 and the boost module 140 in the backlight control module 14 to supply power to the backlight module 10, and is usually 12 Volt or 20 Volt, and the disclosure will not be limited thereto.

In this or some embodiments, for the PWM backlight controller 142 in the backlight control module 14, the input pin pin_1 is a pin DIM (i.e. a light dimming pin), the output pin pin_2 is an pin ISET, the input pin pin_3 is a pin EN (i.e. an enable pin), the input pin pin_4 is a pin VCC, and the input pin pin_5 is a pin GND (i.e. a grounded pin).

The flicker removing module 16 includes a resistance unit 160, a voltage modulation unit 162 and a digital to analog conversion unit 164. One end of the resistance unit 160 is electrically connected to the output pin pin_2 and the resistance unit 15. The voltage modulation unit 162 is supplied with the external power source Vin outputted by the signal input module 18. The digital to analog conversion unit 164 is supplied with the PWM signal PWMsignal outputted by the signal input module 18, and is electrically connected between the voltage modulation unit 162 and the resistance unit 160.

The voltage modulation unit 162 is firstly supplied with the external power source Vin outputted by the signal input module 18 and then outputs a set of second voltages V2. In this or some embodiments, the voltage modulation unit 162 can be a DC voltage regulator. Assume that the external power source Vin is 12 volt. The voltage modulation unit 162 can be a voltage regulator converting 12 Volt into 5 Volt. Therefore, the second voltage V2 outputted by the voltage modulation unit 162 will be 5 Volt.

The digital to analog conversion unit 164 is supplied with the PWM signal PWMsignal and the second voltage V2 and controls the voltage difference between two ends of the resistance unit 160, so as to control the output current Iout outputted by the output pin pin_2. The voltage difference is equal to the voltage Vout1 minus the voltage Vout2. In this or some embodiments, the digital to analog conversion unit 164 is a digital-to-analog converter (DAC) converting the PWM signal PWMsignal from a digital format into an analog format.

Specifically, while the duty cycle of the PWM signal PWMsignal outputted by the signal input module 18 is increased, the voltage Vout2 of the analog voltage signal outputted by the digital to analog conversion unit 164 will be decreased. Since the voltage potential Vout1 at the output pin pin_2 is constant, the current I2, which passes through the resistance unit 160 and is obtained by dividing the result of the voltage potential Vout1 minus the voltage potential Vout2 by the resistance of the resistance unit 160, becomes greater. Moreover, the output current Iout outputted by the output pin pin_2 is equal to the current I1 plus the current I2, so that the output current Iout outputted by the output pin pin_2 will become greater if the current I1 passing through the resistance unit 15 is constant. Herein, when the input current Iin becomes greater according to the output current Iout, the backlight brightness to the backlight module 10 will be greater. In contrast, while the duty cycle of the PWM signal PWMsignal outputted by the signal input module 18 is decreased, the backlight brightness to the backlight module 10 will be decreased.

Figure 5:
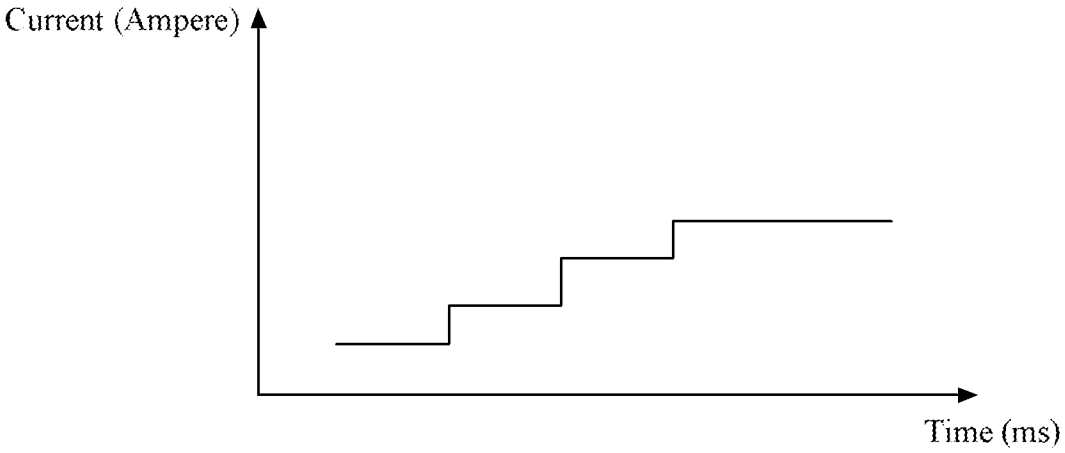
FIG. 5 is a waveform diagram of an output current of the backlight control module in FIG. 4 according to an embodiment of the disclosure.

Therefore, when the input pin pin_1 of the PWM backlight controller 142 in the backlight control module 14 is supplied with the first voltage V1 outputted by the signal input module 18, the input current Iin will become continuous and have no frequency variation, that is, the input current Iin will become a linear current as shown in FIG. 5. The greater the output current Iout is, the greater the backlight brightness to the at least one backlight unit in the backlight module 10 will be. In contrast, the less the output current Iout is (not shown), the less the backlight brightness to the at least one backlight unit in the backlight module 10 will be.

The signal input module 18 supplies the external power source Vin to the backlight control module 14 and the voltage modulation unit 162, supplies the first voltage V1 to the backlight control module 14, and supplies the PWM signal PWMsignal to the digital to analog conversion unit 164. In the disclosure, the external power source Vin, the first voltage V1 and the PWM signal PWMsignal can be generated within the signal input module 18, or be obtained from an extra voltage signal generator and an extra PWM signal generator.

Furthermore, the resistance units 15 and 160 respectively include at least one resistor. The disclosure will not be limited by the connection manner and resistance of resistor in the resistance units 15 and 160.

Figure 6:
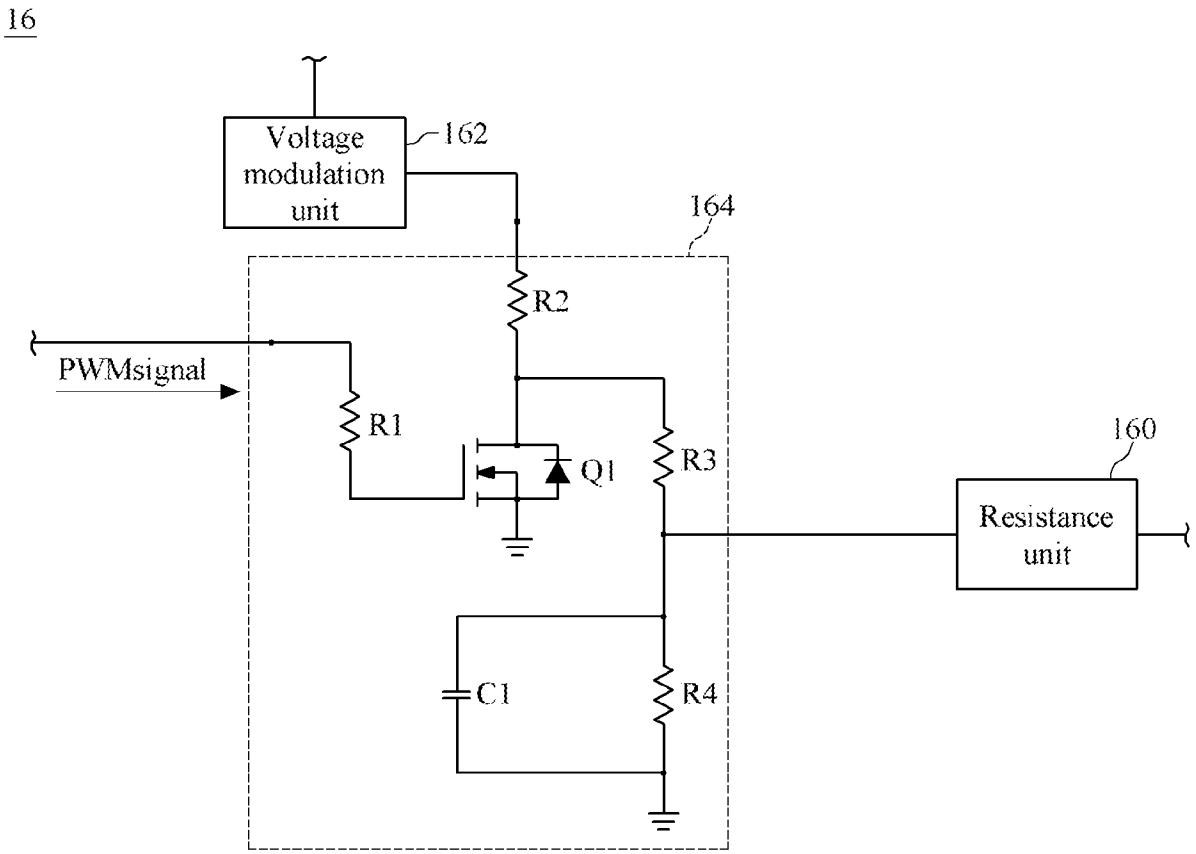
FIG. 6 is a schematic circuit diagram of the digital to analog conversion unit in FIG. 4 according to an embodiment of the disclosure.

FIG. 6 is a schematic circuit diagram of the digital to analog conversion unit in FIG. 4 according to an embodiment of the disclosure. The digital to analog conversion unit 164 includes a resistor R1 (i.e. the first resister), a resister R2 (i.e. the second resister), a resistor R3 (i.e. the third resister), a resistor-capacitor parallel circuit including a resistor R4 and a capacitor C1, and a metal oxide semiconductor field effect transistor (MOSFET) Q1. Specifically, a diode is inversely coupled between the drain and source ends of the MOSFET Q1. In other words, the anode of the diode is coupled to the source end of the MOSFET Q1, and the cathode of the diode is coupled to the drain end of the MOSFET Q1.

The resistor R1 is coupled between the signal input module 18 and the gate end of the MOSFET Q1, and the resistor R2 is coupled between the voltage modulation unit 162 and the drain end of the MOSFET Q1. One end of the resistor R3 is coupled between the resistor R2 and the drain end of the MOSFET Q1, and the other end of the resistor R3 is coupled between the resistance unit 160 and the resistor-capacitor parallel circuit. One end of the resistor-capacitor parallel circuit is coupled between the resistor R3 and the resistance unit 160, and the other end of the resistor-capacitor parallel circuit is grounded. The gate end of the MOSFET Q1 is supplied with the PWM signal PWMsignal through the resistor R1, and the source end of the MOSFET Q1 is grounded.

Additionally, the aforementioned circuitry of the digital to analog conversion unit 164 can be any possible design according to the operation of the digital to analog conversion unit 164 in the disclosure, and will not limit the disclosure.

Figure 7:
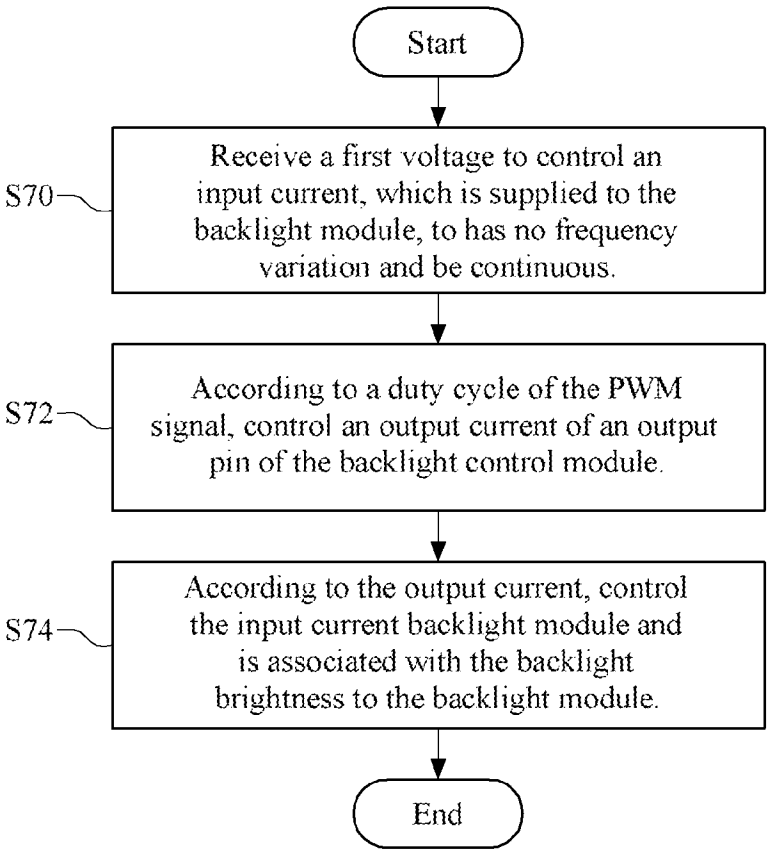
FIG. 7 is a flowchart of a control method performed by the display device in FIG. 4 according to an embodiment of the disclosure.

As set forth above, the operation of the display device in the disclosure is concluded as follows. Refer to FIG. 3 and FIG. 7, a flowchart of a control method according to an embodiment of the disclosure is illustrated. The control method is applicable to the display device 1 including the backlight module 10 and the backlight control module 14 and includes the following steps.

Firstly, the backlight control module 14 is supplied with a first voltage V1, which is the constant DC voltage supplied to the input pin pin_1 of the PWM backlight controller 142, so that an input current Iin supplied to the backlight module 10 is continuous and has no frequency variation (step S70). Subsequently, the display device 1 controls the output current Iout outputted by the output pin pin_2 of the PWM backlight controller 142 in the backlight control module 14 according to the duty cycle of the PWM signal PWMsignal (step S72). Finally, the backlight control module 14 controls the input current Iin supplied to the backlight module 10, according to the output current Iout outputted by the output pin pin_2 of the PWM backlight controller 142 (step S74). The input current Iin is associated with the backlight brightness to the backlight module 10.

The input current Iin outputted by the backlight control module 14 is linear, that is, the input current Iin is continuous and has no frequency variation. The first voltage V1 is supplied to the input pin pin_1 of the PWM backlight controller 142 in the backlight control module 14, and is constant.

On the other hand, in step S72, the display device 1 further receives the external power source Vin to output the second voltage V2, whereby the display device 1 can control the output current Iout outputted by the output pin pin_2 according to the PWM signal PWMsignal and the second voltage V2.

In the disclosure, the display device can receive the constant first voltage via the input pin of the backlight control module, dispose the flicker removing module connected to the output pin of the backlight control module, and receive the pulse width modulation signal to control the output current outputted by the output pin, so that the backlight control module can control the backlight brightness to the display device according to the output current. In this way, even though the display device does not use the design of the mainboard in the conventional display device, the disclosure can still perform the linear current dimming manner, and may remove the flickers and reduce the irritation of blue light to human eyes.

What is claimed is:

1. A display device, comprising:

a backlight module comprising at least one backlight unit configured to provide a display panel with a backlight source;

a backlight control module having an input pin and an output pin between which the backlight module is electrically connected, and receiving a first voltage via the input pin to control a continuity of an input current supplied to the backlight module; and a flicker removing module electrically connected to the output pin, and configured to receive a pulse width modulation (PWM) signal and drain a modulating current from the output pin according to a duty cycle of the PWM signal so as to control an output current outputted by the output pin;

wherein the backlight control module according to the output current controls the input current supplied to the backlight module, and the input current is associated with a backlight brightness to the at least one backlight unit.

2. The display device according to claim 1, wherein the output current outputted by the output pin is controllable.

3. The display device according to claim 1, wherein the first voltage is constant and is used for controlling the continuity of the input current supplied to the backlight module.

4. The display device according to claim 1, wherein the backlight control module further comprises a PWM backlight controller having a DIM pin and an ISET pin, the input pin is coupled to the DIM pin, and the output pin is coupled to the ISET pin.

5. The display device according to claim 1, wherein the backlight unit includes a light emitting diode (LED).

6. The display device according to claim 1, wherein the flicker removing module comprises:

a resistance unit electrically connected to the output pin;

a voltage modulation unit configured to receive an external power source to generate a second voltage; and a digital to analog conversion unit electrically connected between the resistance unit and the voltage modulation unit, and configured to receive the PWM signal and the second voltage to control a voltage difference between two ends of the resistance unit, so as to control the output current of the output pin.

7. The display device according to claim 6, wherein the display device further comprises a signal input module which is electrically connected to the backlight control module and the flicker removing module and is configured to supply the external power source to the backlight control module and the voltage modulation unit, supply the first voltage to the backlight control module, and supply the PWM signal to the digital to analog conversion unit.

8. The display device according to claim 7, wherein the digital to analog conversion unit comprises:

a first resister coupled to the signal input module;

a second resister coupled to the voltage modulation unit;

a third resister coupled to the second resister and the resistance unit;

a resistor-capacitor parallel circuit coupled between the third resister and the resistance unit and being grounded; and a metal oxide semiconductor field effect transistor (MOSFET) having a gate end, a source end and a drain end, the gate end of the MOSFET being coupled to the first resister to receive the PWM signal, the drain end of the MOSFET being coupled between the second resister and the third resister, and the source end of the MOSFET being grounded.

9. The display device according to claim 8, wherein a diode is inversely connected between the drain and source ends of the MOSFET.

10. A control method for a display device comprising a backlight module and a backlight control module, and the control method comprising:

receiving a first voltage to supply the first voltage to the backlight module;

controlling an output current outputted by an output pin of the backlight control module by draining a modulating current from the output pin according to a duty cycle of a pulse width modulation (PWM) signal; and according to the output current, controlling an input current which is supplied to the backlight module and is associated with a backlight brightness to the backlight module.

11. The control method according to claim 10, wherein the output current outputted by the output pin is controllable.

12. The control method according to claim 10, wherein the first voltage is constant and is used for controlling a continuity of the input current supplied to the backlight module.

13. The control method according to claim 10, wherein the backlight control module comprises a PWM backlight controller having an input pin and an output pin, the input pin of the PWM backlight controller is a DIM pin, and the output pin of the PWM backlight controller is an ISET pin.

* * * * *